US011791580B2

(12) United States Patent
Hsu et al.

(10) Patent No.: US 11,791,580 B2
(45) Date of Patent: Oct. 17, 2023

(54) PLUG CONNECTOR AND CONNECTOR ASSEMBLY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Yang-Tsun Hsu, New Taipei (TW); Jun Chen, Kunshan (CN); Fan-Bo Meng, Kunshan (CN); Cai-Yuan Wang, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 121 days.

(21) Appl. No.: 17/405,432

(22) Filed: Aug. 18, 2021

(65) Prior Publication Data

US 2022/0059958 A1 Feb. 24, 2022

(30) Foreign Application Priority Data

Aug. 19, 2020 (CN) ..... 202010838356.8

(51) Int. Cl.

| | |
|---|---|
| ***H01R 12/72*** | (2011.01) |
| ***H01R 12/75*** | (2011.01) |
| ***H01R 13/422*** | (2006.01) |

(52) U.S. Cl.

CPC ..... *H01R 12/727* (2013.01); *H01R 12/75* (2013.01); *H01R 13/4226* (2013.01)

(58) Field of Classification Search

CPC .. H01R 12/79; H01R 13/506; H01R 13/6275; H01R 13/4226; H01R 12/75; H01R 12/727

See application file for complete search history.

(56) References Cited

U.S. PATENT DOCUMENTS

| | | | | |
|---|---|---|---|---|
| 10,205,256 | B2 * | 2/2019 | Wu | H01R 12/7005 |
| 10,270,191 | B1 * | 4/2019 | Li | H01R 12/771 |
| 10,601,181 | B2 | 3/2020 | Amphenol | |

FOREIGN PATENT DOCUMENTS

| | | | |
|---|---|---|---|
| CN | 207398496 | | 5/2018 |
| CN | 207834719 U | * | 9/2018 |

* cited by examiner

*Primary Examiner* — Briggitte R. Hammond
(74) *Attorney, Agent, or Firm* — Ming Chieh Chang

(57) ABSTRACT

A plug connector for mating with a receptacle connector which is provided with a groove at an upper surface thereof includes: an insulating body; and a locking elastic piece on the insulating body, wherein the insulating body includes a main body and a mating portion extending forward from the main body, a bottom of the mating portion protrudes downward to form a sinking portion, and the sinking portion is located entirely above the groove.

8 Claims, 6 Drawing Sheets

PLUG CONNECTOR AND CONNECTOR ASSEMBLY

BACKGROUND OF THE INVENTION

1. Field of the Invention

The present invention relates generally to a plug connector and a connector assembly including the plug connector, and more particularly to a plug connector and a connector assembly with lower height.

2. Description of Related Arts

China Patent No. 207398496 discloses a connector including an insulating body, a PCB board fixed on the insulating body, and a cable electrically connected to the PCB board and extending rearward out of the insulating body. However, the size of the connector is large and it takes up more space, which is not desired in miniaturization of the connector.

An improved connector is desired.

SUMMARY OF THE INVENTION

A main object of the present invention is to provide a plug connector and a connector assembly including the plug connector that has a lower height.

To achieve the above-mentioned object, a plug connector for mating with a receptacle connector which is provided with a groove at an upper surface thereof comprises: an insulating body; and a locking elastic piece on the insulating body, wherein the insulating body includes a main body and a mating portion extending forward from the main body, a bottom of the mating portion protrudes downward to form a sinking portion, and the sinking portion is located entirely above the groove.

To achieve the above-mentioned object, a connector assembly comprises: a plug connector including an insulating body and a locking elastic piece on the insulating body; and a receptacle connector for mating with the plug connector has a groove at an upper surface thereof, wherein the insulating body includes a main body and a mating portion extending forward from the main body, a bottom of the mating portion protrudes downward to form a sinking portion, and the sinking portion is located entirely above the groove.

Compared to the prior art, the present invention not only reduces the height of the plug connector but also enhances the stability of the plug connector structure by providing a sinking portion at the bottom of the mating portion.

DETAILED DESCRIPTION OF THE PREFERRED EMBODIMENT

Figure 1:
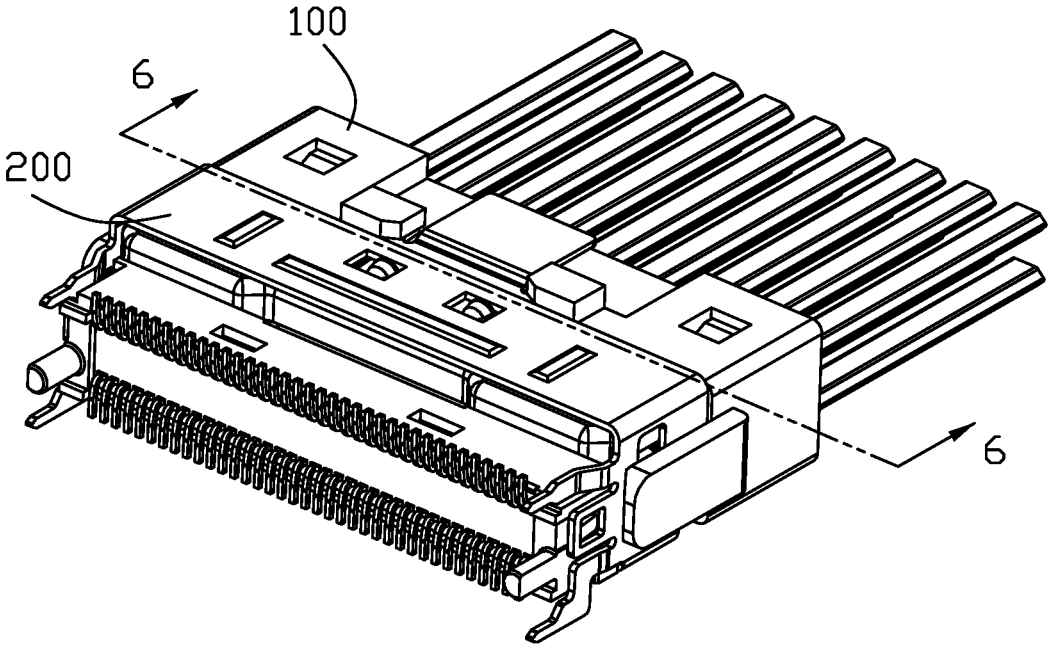
FIG. 1 is a perspective view of a plug connector and a receptacle connector in a mated state in accordance with the present invention.
Figure 2:
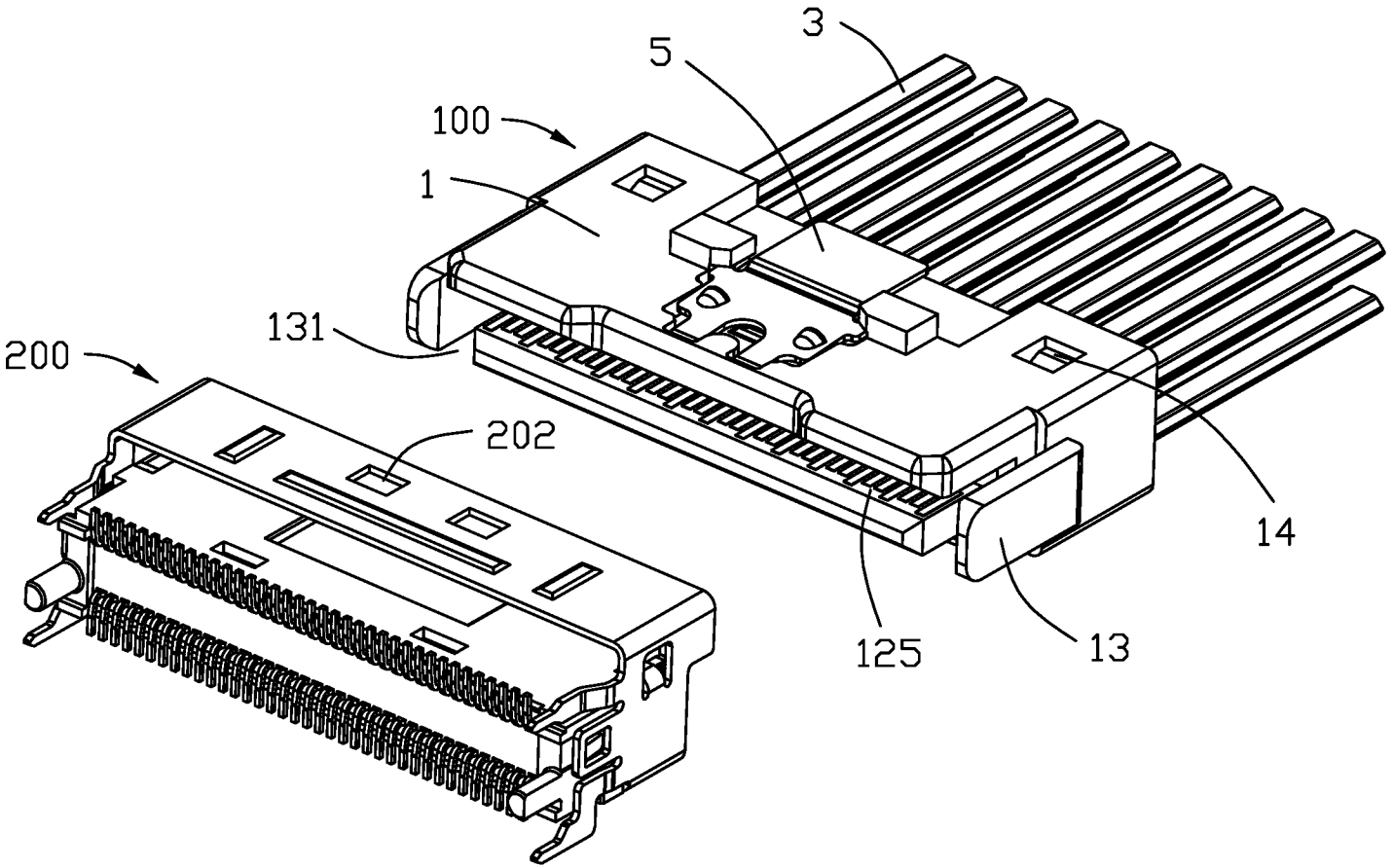
FIG. 2 is a perspective view of the plug connector and the receptacle connector in an unmated state in FIG. 1.
Figure 3:
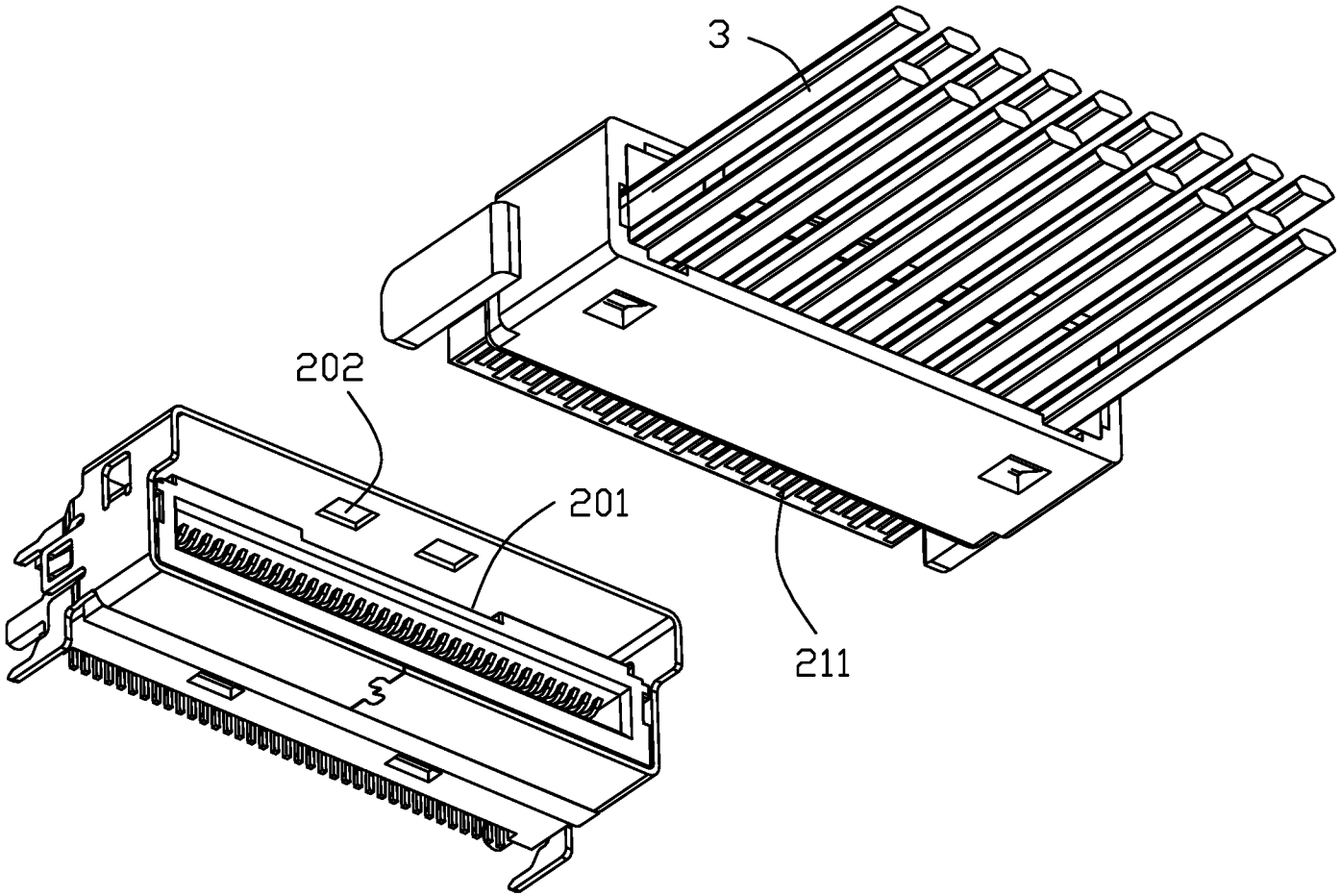
FIG. 3 is another perspective view of the plug connector and the receptacle connector in FIG. 2.
Figure 4:
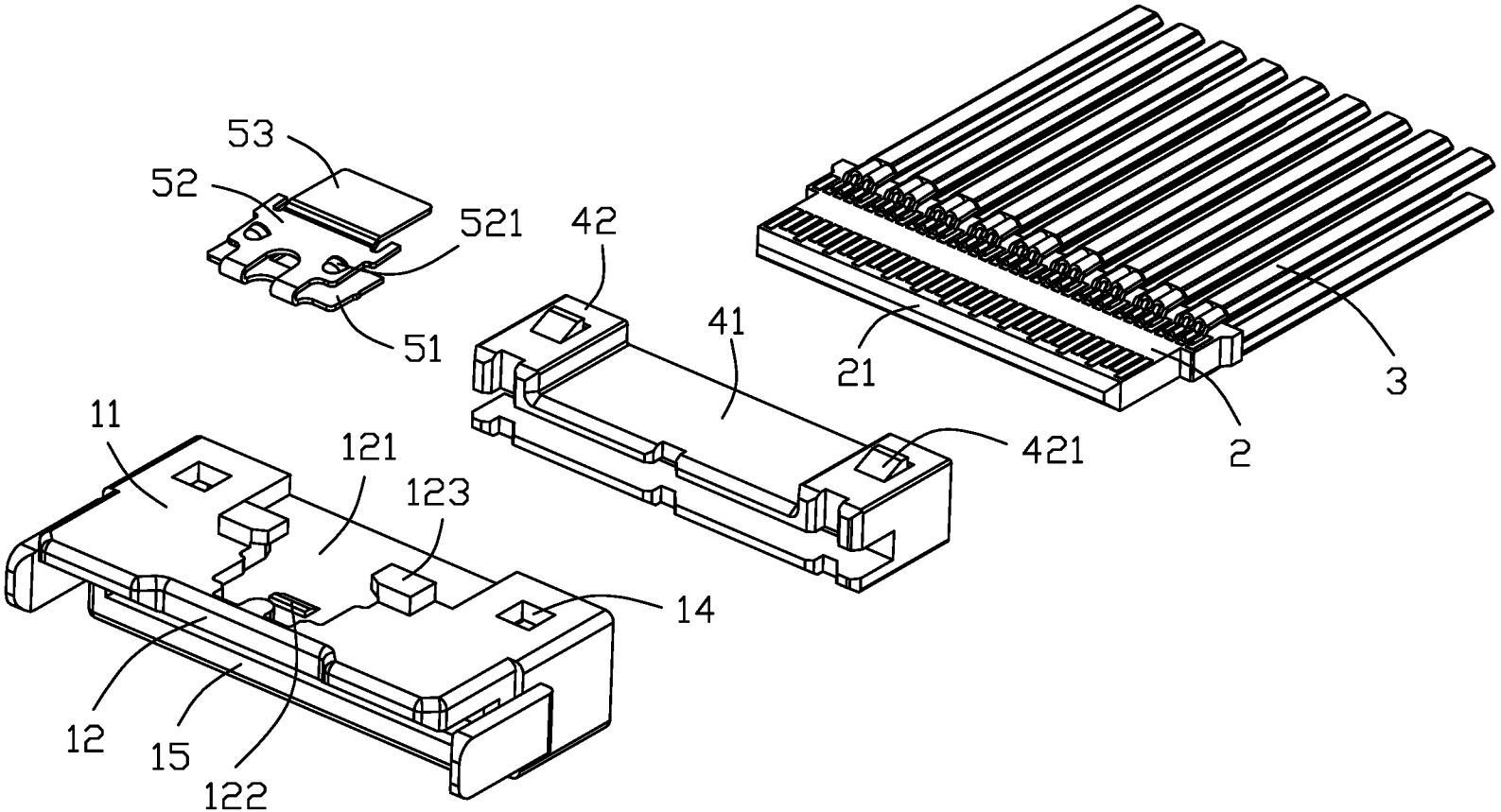
FIG. 4 is a exploded view of the plug connector in FIG. 2.
Figure 5:
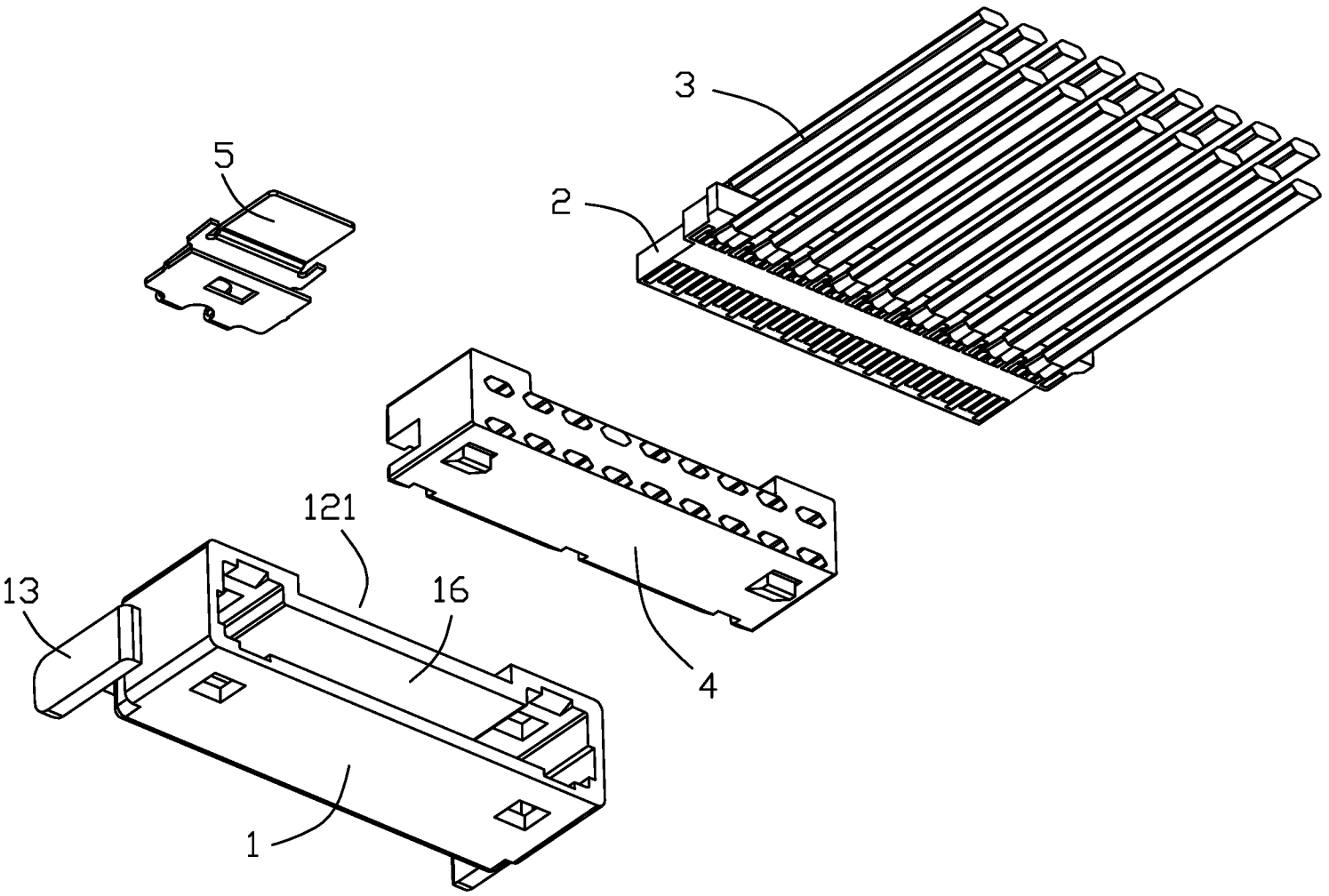
FIG. 5 is another exploded view of the plug connector in FIG. 4.
Figure 6:
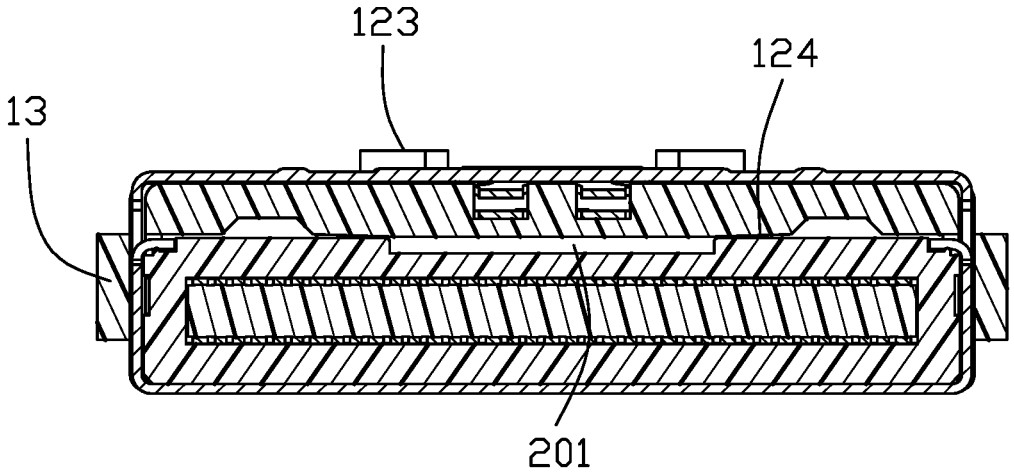
FIG. 6 is a cross-sectional view along line 6-6 of the plug connector and receptacle connector in FIG. 1.

Referring to FIGS. 1-6, a plug connector 100 in accordance with the present invention is used to lock and mate with the receptacle connector 200. The plug connector 100 includes an insulating body 1, a circuit board housed in the insulating body 1, a cable 3 electrically connected to the circuit board 2, an inner mold 4 covering the connection between the circuit board 2 and the cable 3, and a locking elastic piece 5 located on the insulating body 1. The upper surface of the receptacle connector 200 is provided with a groove 201.

The insulating body 1 includes a main body 11, a mating portion 12 protruding forward from the main body 11, a pair of side baffles 13 on the left and right sides of the main body 11, square holes 14 on the upper surface of the main body 11, an opening 15 located at the front end of the main body 11, and a channel 16 communicating with the opening 15. The upper surface of the mating portion 12 is provided with a recess portion 121 extending from front to back, a protrusion 122 for fixing the locking elastic piece 5, and bosses 123 located on both sides of the locking elastic piece 5. The front end of the recess portion 121 does not penetrate the upper surface of the mating portion 12 forwardly. The lower surface of the mating portion 12 is provided with a downwardly protruding sinking portion 124, so that the thickness of the front surface of the mating portion 12 is increased, and the stability of the plug connector structure is enhanced. The sinking portion 124 is located above the groove 201 and does not enter the groove 201. A second limiting groove 131 is formed between the side baffles 13 and the circuit board 2. The second limiting groove 131 forms left and right limiting positions to guide the plug connector 100 and the receptacle connector 200 to be mated.

The circuit board 2 includes an insertion portion 21 extending out of the opening 15. The upper and lower surfaces of the insertion portion 21 are provided with a plurality of metal pad 211. The mating portion 12 is located on the upper side of the insertion portion 21, and a first limiting groove 125 is formed between the mating portion 12 and the insertion portion 21. The first limiting groove 125 can form a limit in the up and down direction when the plug connector 100 and the receptacle connector 200 are mated, so as to prevent the circuit board 2 from being inserted obliquely, and to prevent pin breakage (The terminal is deformed and cannot be restored to its original state).

The front ends of the cables 3 are respectively soldered to the upper surface and the lower surface of the circuit board, and the rear ends of the cables 3 extend out of the insulating body 1.

The upper surface of the inner mold 4 is provided with a downwardly recessed middle portion 41 and protruding portions 42 located on both sides of the recessed middle portion 41. Each of the protruding portions 42 is provided with a convex rib 421 that cooperates with the corresponding square hole 14. The inner mold 4 enters the insulating body 1 through the channel 16, so that the convex ribs 421 and the square holes 14 are snapped together to prevent the inner mold 4 from exiting the insulating body 1.

The locking elastic piece 5 is installed in the recess portion 121. The locking elastic piece 5 includes a fixing portion 51 that is buckled and fixed with the protrusion 122, an elastic portion 52 connected to the fixing portion 51, and a pressing portion 53 provided at the rear end of the elastic portion 52. The upper surface of the elastic portion 52 is provided with a locking protrusion part 521 for mating with the locking hole 202 of the receptacle connector 200. The elastic portion 52 can drive the locking protrusion part 521 to elastically swing up and down. Since the recess portion 121 is recessed inward, enough space is left between the pressing portion 53 and the upper surface of the recess portion 121 for the user to press the locking elastic piece 5 to unlock it, thereby reducing the overall height of the cable connector 100, realize the connector miniaturization.

The above is only one of the embodiments of the present invention, but not all or the only embodiments. Any equivalent changes to the technical solutions of the present invention by those skilled in the art by reading the description of the present invention are covered by the claims of the present invention.

What is claimed is:

1. A connector assembly comprising:

a plug connector including:

an insulating body; and a locking elastic piece on the insulating body; and a receptacle connector for mating with the plug connector, the receptacle connector having a groove at an upper surface thereof, wherein the insulating body includes a main body and a mating portion extending forward from the main body, a bottom of the mating portion protrudes downward to form a sinking portion, and the sinking portion is located entirely above the groove;

the plug connector includes a circuit board housed in the insulating body, and the circuit board includes an insertion portion extending forward from the main body; and the plug connector includes an inner mold assembled in the insulating body and a cable electrically connected to the circuit board, and the inner mold covers the connection between the circuit board and the cable.

2. The connector assembly as claimed in claim 1, wherein the mating portion is located on an upper side of the insertion portion, and a limiting groove is formed between the mating portion and the insertion portion.

3. The connector assembly as claimed in claim 1, wherein a pair of side baffles are provided on left and right sides of the insulating body, and a limiting groove is formed between each of the side baffles and the circuit board.

4. The connector assembly as claimed in claim 1, wherein an upper surface of the mating portion is provided with a recess portion extending from front to back, and the locking elastic piece is installed in the recess portion.

5. The connector assembly as claimed in claim 4, wherein the locking elastic piece includes a fixed portion installed in the recess portion, an elastic portion connected with the fixed portion, and a pressing portion arranged at a rear end of the elastic portion.

6. The connector assembly as claimed in claim 1, wherein the insulating body includes a pair of holes on an upper surface of the main body, an opening at a front end of the main body, and a channel communicating with the opening.

7. The connector assembly as claimed in claim 6, wherein an upper surface of the inner mold is provided with a downwardly recessed middle portion and protruding portions located on both sides of the recessed middle portion, and the protruding portions are provided with convex ribs that cooperate with corresponding holes.

8. The connector assembly as claimed in claim 7, wherein the inner mold enters the insulating body through the channel, so that the convex rib and the hole are snapped together.

* * * * *